US006264114B1

(12) United States Patent
Chow

(10) Patent No.: US 6,264,114 B1
(45) Date of Patent: Jul. 24, 2001

(54) DRINKING STRAW

(76) Inventor: Robert Chung Nam Chow, 327 N Sierra Vista St., Monterey Park, CA (US) 91755-1985

( * ) Notice: Subject to any disclaimer, the term of this patent is extended or adjusted under 35 U.S.C. 154(b) by 0 days.

(21) Appl. No.: 09/483,822

(22) Filed: Jan. 15, 2000

Related U.S. Application Data

(60) Provisional application No. 60/116,151, filed on Jan. 16, 1999.

(51) Int. Cl.[7] ..... A47G 21/18
(52) U.S. Cl. ..... 239/33
(58) Field of Search ..... 239/33

(56) References Cited

U.S. PATENT DOCUMENTS 2,570,366 * 10/1951 Mitchell ..... 239/33
2,943,794 * 7/1960 Sussman ..... 239/33
5,427,315 * 6/1995 Lipson ..... 239/33
5,584,434 * 12/1996 Lipson ..... 239/33

FOREIGN PATENT DOCUMENTS

2032756 * 5/1980 (GB) ..... 239/33

* cited by examiner

*Primary Examiner*—Lesley D. Morris
(74) *Attorney, Agent, or Firm*—Raymond Y. Chan; David and Raymond Patent Group

(57) ABSTRACT

A drinking straw includes a straw, a fixed collar, and a moveable collar. The straw has an upper part having an open upper end for reception in the mouth of a user, a lower part having an open lower end for immersion in a liquid to be sucked through the straw by the user, a convoluted part provided between the upper and lower parts, a passageway extending through the fix collar and a side wall of the lower part of the straw, and a moveable collar for selectively closing and opening the passageway, whereby when the passageway is in an opening position inside the moveable collar, air is sucked into the straw through the passageway when liquid is sucked through the straw by the user, thereby to create vibrations in the convoluted part of the straw.

4 Claims, 3 Drawing Sheets

DRINKING STRAW

This application claim benefit to provisional application No. 60/116,151 Jan. 16, 1999.

BACKGROUND OF THE PRESENT INVENTION

1. Field of the Present Invention

The present invention relates to a drinking straw, and more particularly to a drinking straw that can selectively provide a vibrating convoluted part when sucking liquid through the straw.

2. Description of Related Arts

Conventional drinking straws have been manufactured of plain coated paper and plastic material and it is know to provide drinking straws of transparent plastic materials with convoluted parts between the upper and lower ends of the straw. These convoluted parts do not enhance the drinking capability of the straw but are present as decorative features. And, a dynamic function by the vibration in itself is more interesting and attractive in its usage and appearance, so as to increase the sales potential of the straws.

SUMMARY OF THE PRESENT INVENTION

It is an object of the present invention to provide a new form of such decorative and dynamic drinking straw. In accordance with the invention, a drinking straw is provided, which comprises a straw, a fixed collar, and a moveable collar. The straw has an upper part having an open upper end for reception in the mouth of a user, a lower part having an open lower end for immersion in a liquid to be sucked through the straw by the user, a convoluted part provided between the upper and lower parts a passageway extending through the fix collar and a side wall of the lower part in cooperation with the embodiment of the moveable collar, and means for selectively closing and opening the passageway, whereby when the passageway is in an opening position inside the moveable collar, air is sucked into the straw through the passageway when liquid is sucked through the straw by the user, thereby to create vibrations in the convoluted part of the straw.

DETAILED DESCRIPTION OF THE PREFERRED EMBODIMENT

Figures 1A, 1B:
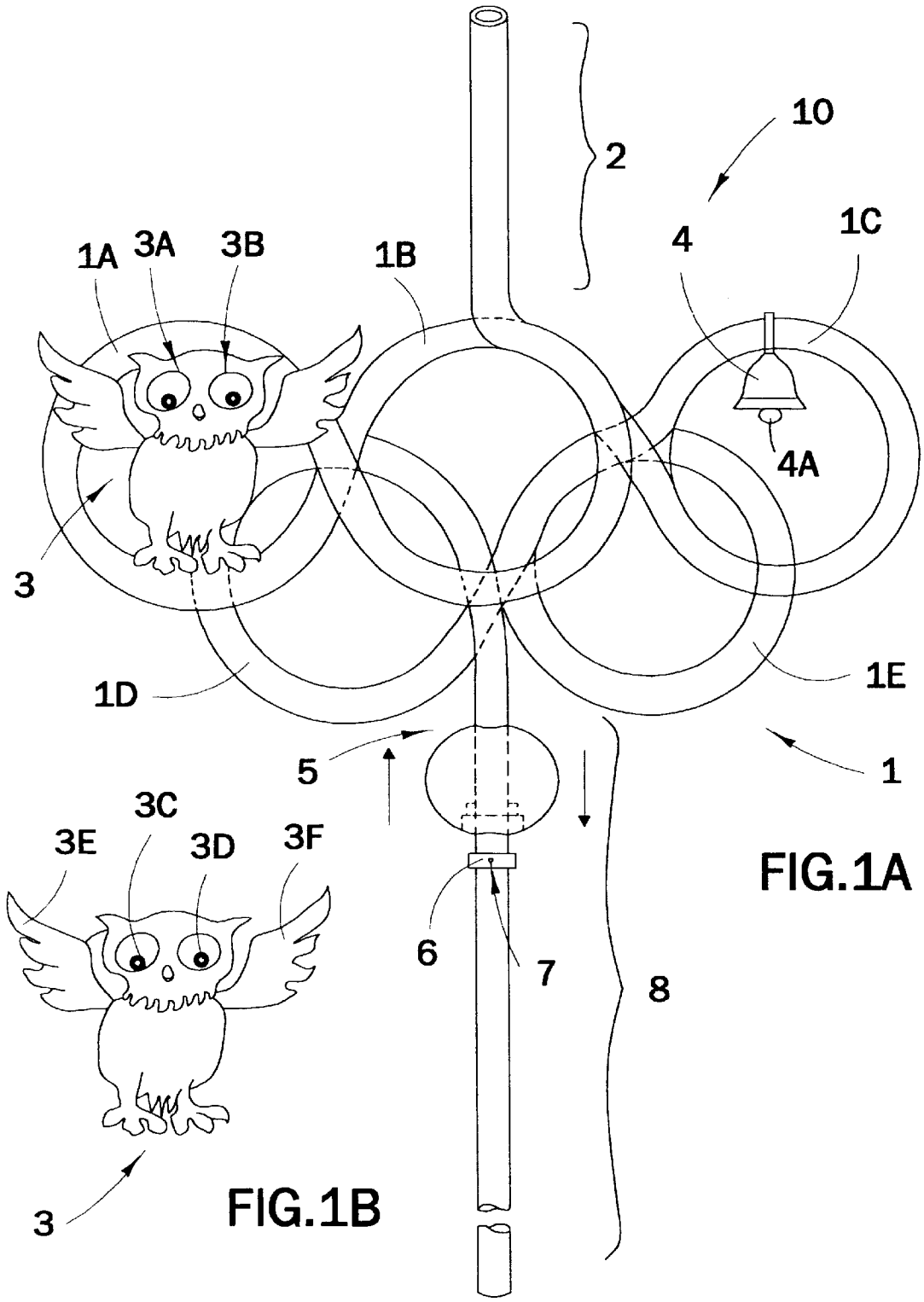
FIG. 1A is a front view of a drinking straw according to a preferred embodiment of the present invention.
FIG. 1B is a front view of a visible moveable element as shown in FIG. 1A.
Figure 2A:
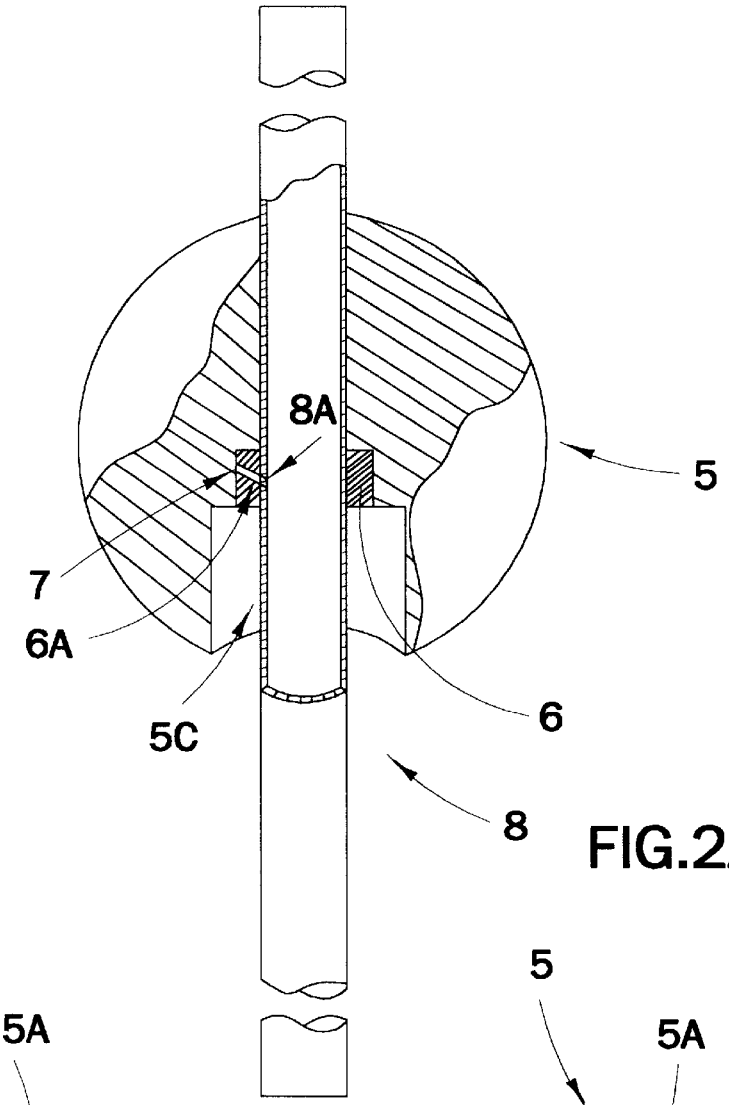
FIG. 2A is a partial sectional front view of the lower part working with the moveable collar and the fixed collar, in closing passageway condition, according to the above preferred embodiment of the present invention.
Figure 2B:
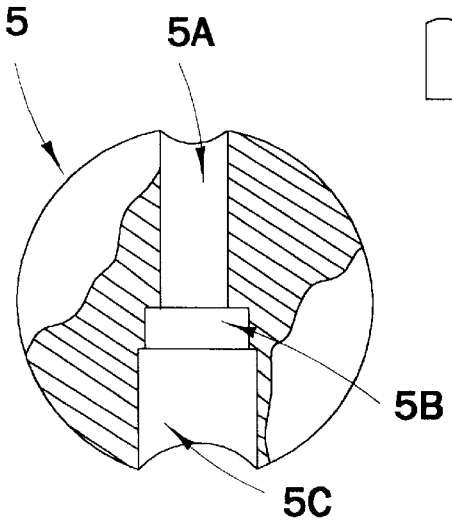
FIG. 2B is a partially sectional front view of the moveable collar according to the above preferred embodiment of the present invention.
Figure 2C:
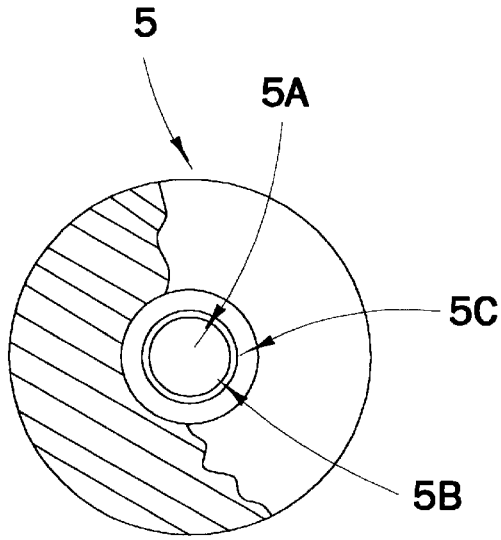
FIG. 2C is a partially sectional top view of the moveable collar according to the above preferred embodiment of the present invention.
Figure 3A:
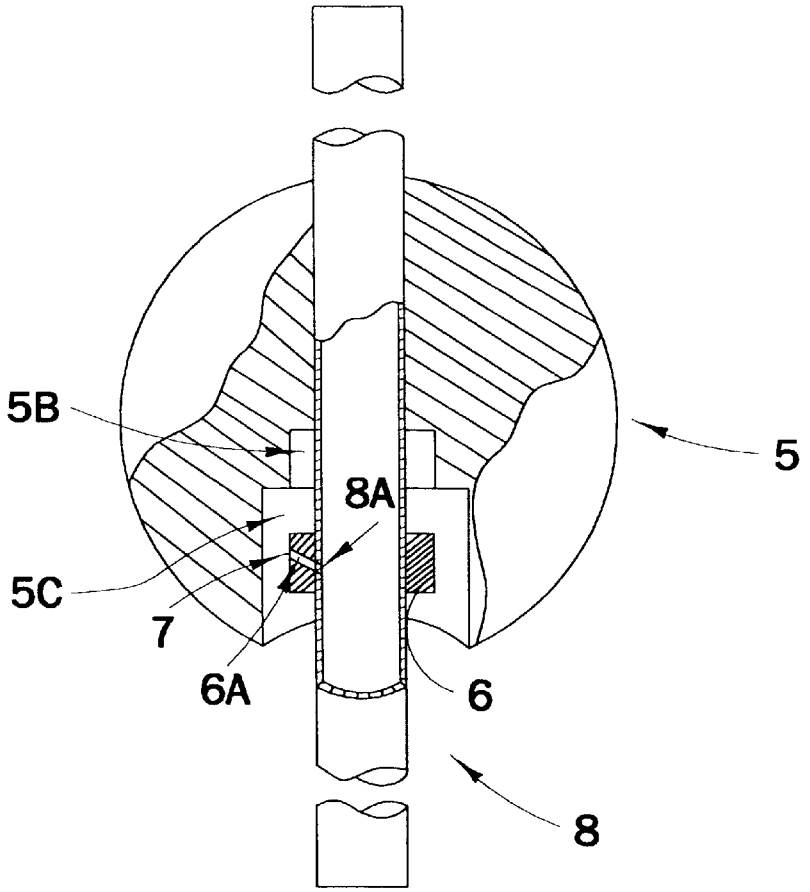
FIG. 3A illustrates the opening condition of the passageway for air and liquid to be sucked in while the moveable collar is slid upward along the lower end of the straw in the vertical channel, with each of its three cylindrical channel sections in different diameters performing positioning and spacing, according to the above preferred embodiment of the present invention.
Figure 3B:
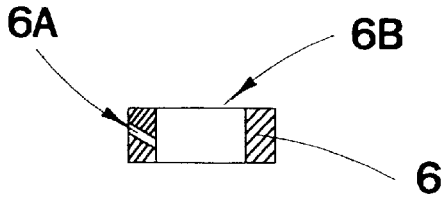
FIG. 3B is a sectional front view of the fixed collar according to the above preferred embodiment of the present invention.
Figure 3C:
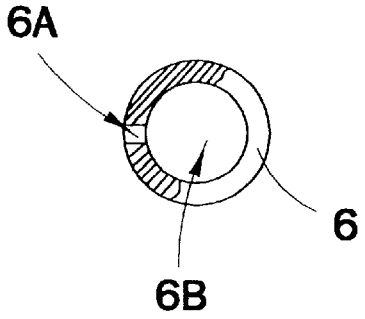
FIG. 3C is a partially sectional top view of the fixed collar according to the above preferred embodiment of the present invention.

Referring to FIGS. 1A to 3C, a drinking straw according to a preferred embodiment of the present invention is illustrated, which comprises a straw 10, a fixed collar 6, and a moveable collar 5. The straw 10 has an upper part 2 having an open upper end for reception in the mouth of a user, a lower part 8 having an open lower end for immersion in a liquid to be sucked through the straw by the user, a convoluted part 1 provided between the upper and lower parts 2, 8, a passageway 7 extending through an inclined hole 6A of the fix collar 6 and a side hole 8A of a side wall of the lower part 8 of the straw 10 in cooperation with the embodiment of the moveable collar 5, and means for selectively closing and opening the passageway 7, whereby when the passageway 7 is in an opening position inside the moveable collar 5, air is sucked into the straw 10 through the passageway when liquid is sucked through the straw 10 by the user, thereby to create vibrations in the convoluted part 1 of the straw 10.

The means for selectively closing and opening the passageway 7 conveniently comprises the moveable collar 5 slidably mounted on the lower part 8 of the straw 10 for enabling movement between the range from convoluted part 1 and the fixed collar 6 which has a central hole 6B for slidably mounting on the lower part 8 of the straw 10. The passageway 7 formed inclining through the side wall of the lower end 8 the fixed collar 6 may be fully occluded or opened by the moveable collar 5.

The moveable collar 5 has a vertical channel which has cylindrical channel sections 5A, 5B, 5C provided in different diameters. While the moveable collar 5 is slid downwards along the lower end 8 until the ladder and inner diameter of the cylindrical section 5B closely occludes a right position of the fixed collar 6, the passageway 7 is sealed fitfully with the moveable collar 5 which is stopped in the designated position at the lower end 8 without being sliding further out of it. The straw 10 at that point is used as a conventional one and only the liquid can be sucked through it.

The moveable collar 5 is convolutions positionable at position moving upwards until it is hitting the convoluted part 1, such as convolutions 1D or 1E, the cylindrical channel section 5C with its inner diameter larger than the outer diameter of the fixed collar 6 (2–3 mm larger). In the mean time, the moveable collar 5 comes to the spacing position of rightly opening the passageway 7 to its air communication. By this, the air through the passageway 7 would be sucked into the straw 10 together with the liquid, creating certain dynamic vibrations in the whole of the convoluted part 1 up there and which give the power to make the objects or article 3, 4 attached onto the convoluted part 1 get some physical or mechanic movements or actions as designated, for example a light weighted bird made of hard plastic sheet, wherein the thin and hard wings 3E, 3F thereof, free from the attachment to but touched against the convoluted part 1, would be flapping up as the aid vibrations pass the impacting energy to them while the bird's body sticks firmly on the vibrating convoluted part 1. Moreover, the pupils 3C, 3D contain freely in bird's eye balls would also be turning round by the same vibrations. Or a small bell 4 would be rung up as its free hammer 4A can be swung up by the vibration, too.

The convoluted part 1 of the straw 10 comprises a plurality of generally circular convolutions 1A, 1B, 1C, 1D, 1E subject to vibrating movement when liquid is sucked through the straw 10 when the passageway 7 is open. The straw 10 is of substantially uniform cross-section throughout having an internal diameter of around 4 mm and is conveniently formed of a relatively hard transparent polyvinyl chloride or other suitable plastic material of "food grade" specification.

As mentioned above, the straw 10 is provided with the convoluted part 1 between the straight upper and lower parts 2, 8. The convoluted part 1 comprises five generally circular convolutions 1A–1E providing the appearance of a set of rings when viewed from the front as shown in the FIG. 1.

The passageway 7 is of elliptical cross-sectional form having a major axis parallel of the longitudinal axis of the lower part 8 of around 2 mm. The passageway 7 is inclined downwardly from the outside surface of the side wall of the lower part 8 to the inner surface thereof whereby any liquid running downwardly out of the convolutions 1A–1E cannot run through the passageway 7.

The degree of vibration is dependent upon the force with which the user sucks liquid through the straw 10. It will be appreciated that the moveable collar 5 is slidably movable between the fully occluded position referred to the earlier through positions in which the passageway 7 is opened to the air communication.

The specific pattern of the convolutions 1A–1E in the convoluted part 1 of the straw 10 is not critical to the invention since a vibratory action will always be induced when air is sucked into the straw through the passageway 7. Thus the convolutions 1A–1E need not necessarily be circular and may be present in any convenient number although it is preferred that at least two convolutions 1A–1E are provided in order that they may vibrate relative to one another when air is being sucked into the straw 10 together with liquid.

The claims defining the invention are as follows:

1. A drinking straw, comprising:

a straw having an upper part having an open upper end for reception in a mouth of a user, a lower part having an open lower end for immersion in a liquid to be sucked through said straw by said user, and a convoluted part provided between said upper part and said lower part;

a fixed collar affixed on said lower part of said straw, wherein a passageway is formed and extended through a side wall of said lower part of said straw and said fixed collar; and means for selectively closing and opening said passageway, which comprises a moveable collar having a vertical channel extending therethrough for slidable mounting on said lower part of said straw, said channel having an upper, a middle and a lower cylindrical channel section, said upper cylindrical channel section having a diameter equal to that of said lower part of said straw so as to enable said moveable collar slidable mounting on said lower part of said straw, said middle cylindrical channel section having a middle diameter larger than said diameter of said upper cylindrical channel section and equal to a diameter of said fixed collar for closing said passageway when said middle cylindrical channel section is positioned surrounding said fixed collar, said lower cylindrical channel section having an outer diameter larger than said diameter of said fixed collar for opening said passageway when said lower cylindrical channel section is positioned surrounding said fix collar by sliding said moveable collar upwardly along said lower part of said straw, thereby air is sucked into said straw through said passageway when said liquid is sucked through said straw by said user so as to create vibrations in said convoluted part of said straw.

2. A drinking straw, as recited in claim 1, wherein said convoluted part of said straw comprises a plurality of circular convolutions continuously extended between said upper part and said lower part of said straw, whereby said circular convolutions are subjected to vibrating movement when said liquid is sucked through said straw when said passageway is at least partially opened.

3. A drinking straw, as recited in claim 1, further comprising at least a visible moveable element mounting on said convoluted part.

4. A drinking straw, as recited in claim 2, further comprising at least a visible moveable element mounting on said circular convolutions of said convoluted part.

* * * * *